US005181344A

United States Patent [19]

Joncour et al.

[11] Patent Number: 5,181,344

[45] Date of Patent: Jan. 26, 1993

[54] DEVICE FOR FASTENING A HOLDING PART ON AN EYEGLASS LENS

[75] Inventors: Christian Joncour, Saint Maurice; Alain Chansavoir, Luzancy; Bruno Marande, Sannois, all of France

[73] Assignee: Essilor International CIE Generale d'Optique, Creteil Cedex, France

[21] Appl. No.: 775,021

[22] Filed: Oct. 11, 1991

[30] Foreign Application Priority Data

Oct. 25, 1990 [FR] France ..... 90 13234

[51] Int. Cl.[5] ..... B24B 13/05

[52] U.S. Cl. ..... 51/165.75; 51/165.74; 51/277; 269/126; 269/289 R

[58] Field of Search ..... 51/165.75, 165.74, 277, 51/216 CP, 217 R; 269/126, 289 R

[56] References Cited

U.S. PATENT DOCUMENTS

| | | | |
|---|---|---|---|
| Re. 33,249 | 7/1990 | Schneider | 464/93 |
| 3,020,684 | 2/1962 | Oldfield et al. | 51/235 |
| 3,277,612 | 10/1966 | Brandt | 51/277 |
| 3,304,586 | 2/1967 | Buckminster et al. | 51/277 |
| 4,227,349 | 10/1980 | Bicskei | 51/277 |
| 4,677,729 | 7/1987 | Morland et al. | 51/277 |
| 4,936,056 | 6/1990 | Gaudel et al. | 51/277 |
| 5,070,657 | 12/1991 | Brule et al. | 51/216 LP |

FOREIGN PATENT DOCUMENTS

| | | |
|---|---|---|
| 0111092 | 6/1984 | European Pat. Off. . |
| 0323787 | 7/1989 | European Pat. Off. . |
| 2545948 | 4/1977 | Fed. Rep. of Germany . |

*Primary Examiner*—M. Rachuba
*Attorney, Agent, or Firm*—Young & Thompson

[57] ABSTRACT

A device for fitting a holding part onto an eyeglass lens comprises a plate adapted to receive the eyeglass lens pivoted to a fixed base and a calibrated spring arrangement and a displacement sensor operative between the plate and the base.

15 Claims, 1 Drawing Sheet

FIG. 1
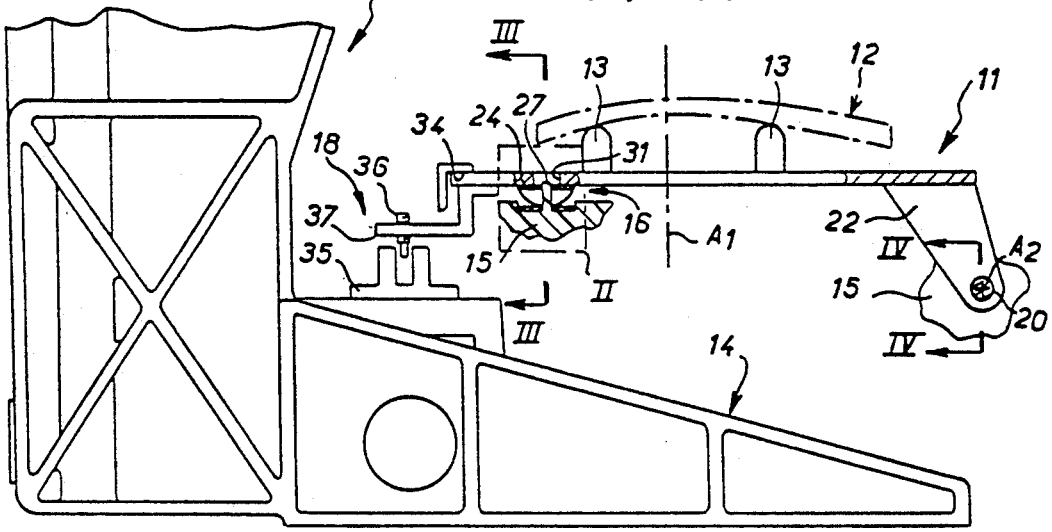
FIG. 2
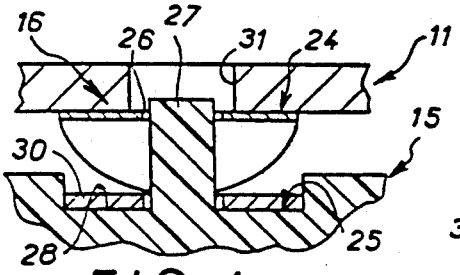
FIG. 4
FIG. 3
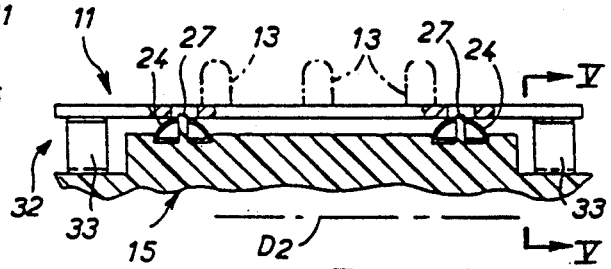
FIG. 9
FIG. 5
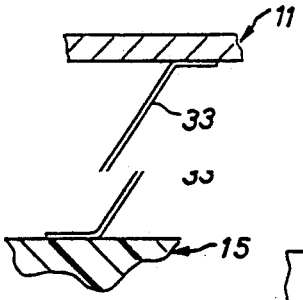
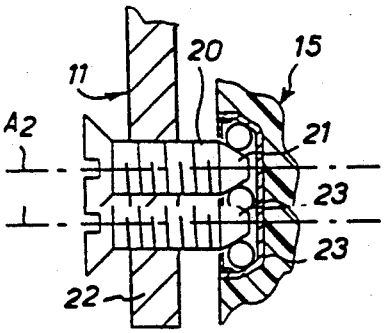
FIG. 6
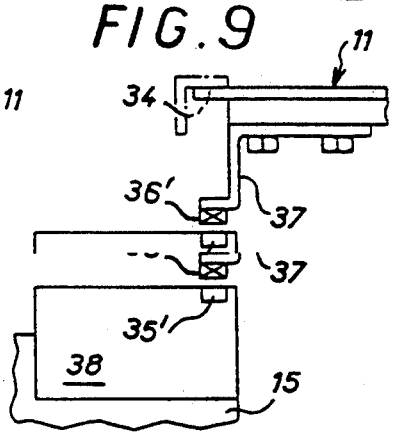
FIG. 8
FIG. 7
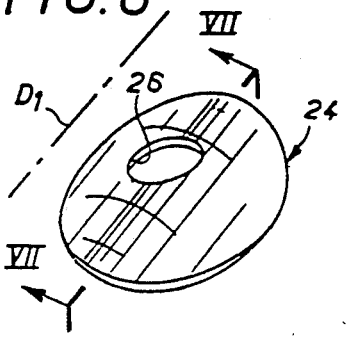
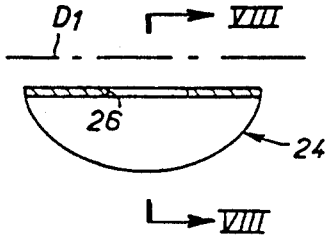
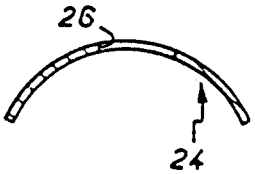

DEVICE FOR FASTENING A HOLDING PART ON AN EYEGLASS LENS

BACKGROUND OF THE INVENTION

1. Field of the Invention

The present invention is generally concerned with fitting a holding part onto an eyeglass lens to be worked on, for example trimmed, the holding part being adapted to adhere to the lens temporarily, by means of a sucker, for example, to enable the lens to be fitted to and locked in position on a machine for carrying out the work.

2. Description of the Prior Art

It is more specifically concerned with a device used to fit a holding part onto an eyeglass lens and comprising a member adapted to receive removably the holding part to be fitted and carried by a carriage movable along a path on which the holding part comes into abutting contact with the eyeglass lens.

One problem to be solved in devices of this kind is the need to control the travel of the carriage accurately and reliably so that after contact with the eyeglass lens the load exerted on the lens is not likely to break it.

A general object of the present invention is a particularly simple and economical arrangement meeting this requirement.

SUMMARY OF THE INVENTION

The present invention consists in a device for fitting a holding part onto an eyeglass lens comprising a plate adapted to receive the eyeglass lens pivoted to a fixed base and calibrated spring means and a displacement sensor operative between said plate and said base.

The calibrated spring means preferably utilize at least one curved spring washer.

A curved spring washer is curved in the manner of a roofing tile.

A curved spring washer has accurately determined spring characteristics.

Readily available through normal trade channels, curved spring washers are relatively low cost items.

The combination in accordance with the invention of at least one such curved spring washer and a displacement sensor has the advantage of enabling very accurate determination of the moment at which, during the fitting of a holding part, the force applied to the eyeglass lens concerned reaches a given value and appropriate action on the drive means of the carriage producing this force.

This is a simple and economical substitute for a pressure sensor that would be much more costly and delicate.

The characteristics and advantages of the invention will emerge from the following description given by way of example with reference to the appended diagrammatic drawings.

BRIEF DESCRIPTION OF THE DRAWINGS

FIG. 1 is a locally cut away part-view in elevation of a device in accordance with the invention.

FIG. 2 shows to a larger scale the detail from FIG. 1 identified by the box II in FIG. 1.

FIG. 3 is a part-view in transverse cross-section on the line III—III in FIG. 1.

FIG. 4 is a part-view in transverse cross-section on the line IV—IV in FIG. 1.

FIG. 5 is a part-view in elevation and cross-section as seen in the direction of the arrow V in FIG. 3.

FIG. 6 is a perspective view to a different scale of one of the curved spring washers used in this device in accordance with the invention.

FIG. 7 is a view of the curved spring washer in longitudinal cross-section on the line VII—VII in FIG. 6.

FIG. 8 is a view of it in transverse cross-section on the line VIII—VIII in FIG. 7.

FIG. 9 is a part-view in elevation similar to that of FIG. 1 and showing an alternative embodiment.

DETAILED DESCRIPTION OF THE INVENTION

As shown in the figures, and in a manner that is known in itself, the device 10 in accordance with the invention for fitting a holding part onto an eyeglass lens comprises a plate 11 forming a centering table adapted to receive the eyeglass lens 12 onto which the holding part (not shown) is to be fitted and having three studs 13 regularly disposed around a fitting axis A1.

As the other components of the device 10 are not relevant to the present invention they are for the most part not shown in the figures and will not be described here.

FIG. 1 shows only part of the frame 14 by means of which the device 10 is attached to any kind of support, for example the frame of a contour-follower device.

According to the invention, the plate 11 is pivoted to a fixed base 15 and between it and the latter calibrated spring means 16 and a displacement sensor 18 to be described later are operative.

The base 15 is shown only diagrammatically in some of the figures as it is not relevant to the present invention either and will therefore not be described in more detail here.

Suffice to say that it is part of an optical enclosure, for example.

In any event, its position relative to the frame 14 is fixed and from the functional point of view it is therefore just as if it were a part of the latter.

The pivot axis A2 of the plate 11 is orthogonal to the fitting axis A1.

It is materially represented by two screws 20 each with a conical tip 21 screwed into respective lugs 22 provided for this purpose on the lower surface of the plate 11 cooperating with two conical bearings 23 provided for this purpose on the base 15 and thus forming two journals.

It will readily be understood that this assembly guarantees accurate positioning of the plate 11 relative to the fitting axis A1, its only degree of freedom being that which allows it to pivot.

The calibrated spring means 16 operative between the plate 11 and the base 15 preferably comprise at least one curved spring washer 24.

A curved spring washer is a metal washer in the shape of a roofing tile in other words a metal washer with an overall cylindrical curvature.

A curved spring washer 24 is shown in isolation in FIGS. 6 through 8.

D1 denotes the direction of its generatrices.

The advantage of a curved spring washer 24 is that when a crushing load is exerted on it it resists with a calibrated spring force.

For example, the force needed to crush it by half is less than half that needed to flatten it completely.

A curved spring washer 24 therefore provides a large margin for maneuver.

Two curved spring washers 24 are employed in this embodiment aligned along a direction D2 parallel to and spaced from the pivot axis A2 of the plate 11.

Both operate on the lower surface of the plate 11.

Each has its concave side facing towards the base 15 and the directions D1 of their generatrices are perpendicular to the pivot axis A2 of the plate 11.

In other words, the directions D1 of their generatrices are parallel to each other and perpendicular to the direction D2 in which they are aligned.

Each curved spring washer 24 is disposed in a housing 25 provided for it on the base 15 and its central opening 26 is engaged over a centering peg 27 projecting from the bottom 28 of the housing 25.

If, as schematically represented by the specific form of shading used in FIG. 2, the base 15 is made from a synthetic material a metal washer 30 is provided on the base 28 of the housing 25 for the curved spring washer 24 to bear on.

To avoid interference with the centering pegs 27 the plate 11 has in line with each of them an aperture 31 adapted to fit at least partly around them.

To alleviate the consequences of any aging of the two curved spring washers 24, even though these are designed to withstand more than 100,000 operating cycles without slackening, auxiliary spring means 32 are provided between the base 15 and the plate 11.

These two leaf springs 33 have a stretched Z-shape and are carried by the base 15. The lower surface of the plate 11 bears on them.

The two leaf springs 33 merely increase slightly the calibration provided by the curved spring washers 24.

To define precisely the rest position of the plate 11 the base 15 carries an abutment 34 against which the spring means 16 and 32 operative between it and the plate 11 urge the plate at all times.

In the FIG. 1 embodiment the displacement sensor 18 comprises a photo-electric cell 35 and a feeler 36, one on each of the base 15 and the plate 11.

In this embodiment the photo-electric cell 35 is carried by the base 15 (the frame 14) and the feeler 36 is carried by the plate 11, at the end of an arm 37 attached to the latter.

The position of the feeler 36 is preferably adjustable.

It may be the end of a screw threaded into the arm 37 carrying it, for example.

As will be readily understood, if a fitting force exerted along the fitting axis A1 causes the plate 11 to pivot about its pivot axis A2 so that it moves down sufficiently, properly calibrated by the calibrated spring means 16 in the form of the curved spring washers 24, the feeler 36 of the displacement sensor 18 covers the photo-electric cell 35.

By arrangements which will not be described here as they do not constitute any part of the present invention, the result is to operate on the drive means fitting a holding part to the eyeglass lens 12 placed on the plate 11.

However, the design of the device is such that the force exerted on the lens can be properly controlled.

Given the lever arms involved, it suffices to choose appropriately the curved spring washers 24 used.

To give a numerical example, the curved spring washers 24 are crushed by one half for a force of 8 N whereas the overcalibration due to the leaf springs 33 is merely 500 g.

It goes without saying that the numerical values given above by way of illustrative example must in no way be regarded as limiting on the invention.

Two modes of operation are feasible depending on the kind of eyeglass lenses to be fitted with the holding part.

In the case of fragile lenses which can withstand only a relatively low fitting force, the holding part is a simple self-adhesive part for which a relatively low fitting force suffices, but for which the possible number of repeat uses is relatively small.

In the case of stronger lenses, that is to say lenses that can withstand higher fitting forces, the holding part used is a sucker which requires a greater fitting force but which can advantageously be used again many times.

By virtue of arrangements that will not be described here as they do not form any part of the present invention, the operator is provided with control means for selecting one or other of these modes of operation.

In the embodiment shown in FIG. 9 the displacement sensor 18 comprises a Hall-effect cell 35', and a magnet 36' one attached to each of the base 15 and the plate 11.

In this embodiment the Hall-effect cell 35' is attached to the base 15, for example through the intermediary of a printed circuit board 38 appropriately attached thereto, as shown in FIG. 9, and the magnet 36' is attached to the plate 11, carried by an arm 37 attached to the latter as previously, for example.

Operation is overall as previously described.

However, the advantage of the Hall-effect cell 35'is that it supplies information proportional to the displacement of the plate 11 and therefore dependent on its position relative to its rest position.

As a result all mechanical adjustments are eliminated, an automatic reset occurring systematically during each operating cycle.

Of course, the present invention is not limited to the embodiments described and shown but encompasses any variant execution therefore especially with regard to the nature of the calibrated spring means used and, when these are curved spring washers, their number and/or orientation.

There is claimed:

1. Device for fitting a holding part onto an eyeglass lens comprising a plate adapted to receive the eyeglass lens pivoted to a fixed base and calibrated spring means and a displacement sensor operative between said plate and said base.

2. Device according to claim 1 wherein said calibrated spring means comprise at least one curved spring washer.

3. Device according to claim 2 wherein said curved spring washer has its concave side facing towards said base.

4. Device according to claim 2 wherein the generatrices of said curved spring washer are perpendicular to the pivot axis of said plate.

5. Device according to claim 2 wherein said curved spring washer is displaced in a housing on said base and is engaged on a centering peg projecting from the bottom of said housing.

6. Device according to claim 5 wherein said base is made from a synthetic material and there is provided on the bottom of said housing in which said curved spring washer is disposed a metal washer for said curved spring washer to bear against.

7. Device according to claim 2 comprising two curved spring washers aligned in a direction parallel to and spaced from the pivot axis of said plate.

8. Device according to claim 1 further comprising auxiliary spring means between said base and said plate.

9. Device according to claim 1 further comprising an abutment against which said spring means operative between said base and said plate urge said plate continuously.

10. Device according to claim 1 wherein the pivot axis of said plate is materially represented by two screws having conical tips cooperating with conical bearings.

11. Device according to claim 1 wherein said displacement sensor comprises a photo-electric cell and a feeler each attached to one of said base and said plate.

12. Device according to claim 11 wherein said feeler is adjustable in position.

13. Device according to claim 11 wherein said photoelectric cell is attached to said base and said feeler is attached to said plate.

14. Device according to claim 1 wherein said displacement sensor comprises a Hall-effect cell and a magnet each attached to one of said base and said plate.

15. Device according to claim 14 wherein said Hall-effect cell is attached to said base and said magnet is attached to said plate.

* * * * *

UNITED STATES PATENT AND TRADEMARK OFFICE

CERTIFICATE OF CORRECTION

PATENT NO. : 5,181,344

DATED : January 26, 1993

INVENTOR(S) : Christian Joncour, et al

It is certified that error appears in the above-indentified patent and that said Letters Patent is hereby corrected as shown below:

Please reprint Figures 4, 5, and 9 with the drawings below.

FIG. 4

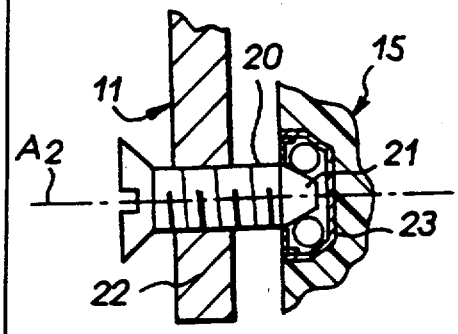

FIG. 5

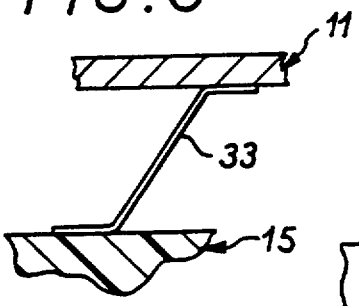

FIG. 9

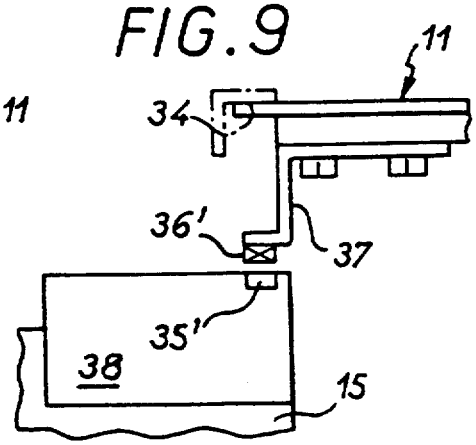

Signed and Sealed this

Twenty-fourth Day of January, 1995

Attest:

Bruce Lehman

BRUCE LEHMAN

Attesting Officer

Commissioner of Patents and Trademarks